US006076201A

United States Patent [19]

Peterson

[11] Patent Number: 6,076,201

[45] Date of Patent: Jun. 20, 2000

[54] PROTECTIVE COVER FOR INFLATABLE SWIMMING POOLS

[75] Inventor: Leroy L. Peterson, Omaha, Nebr.

[73] Assignee: Sportsstuff, Inc., Omaha, Nebr.

[21] Appl. No.: 08/804,095

[22] Filed: Feb. 20, 1997

[51] Int. Cl.[7] ..... E04H 4/00

[52] U.S. Cl. ..... 4/506; 4/585; 441/40; 441/66

[58] Field of Search ..... 4/506, 580, 584, 4/585; 441/40, 42, 66, 129, 130, 131

[56] References Cited

U.S. PATENT DOCUMENTS

| | | | |
|---|---|---|---|
| 2,876,467 | 3/1959 | Lund | 441/40 |
| 3,653,084 | 4/1972 | Hartman | 441/40 |
| 4,083,070 | 4/1978 | Martin | 441/40 |
| 4,136,725 | 1/1979 | Phillips et al. | 4/585 X |
| 4,451,239 | 5/1984 | Hoenstine et al. | 441/66 |
| 4,843,659 | 7/1989 | Popovich et al. | 4/584 X |
| 5,662,506 | 9/1997 | Reinhardt, Jr. et al. | 441/40 |

FOREIGN PATENT DOCUMENTS

| | | | |
|---|---|---|---|
| 0928274 | 5/1955 | Germany | 441/40 |

*Primary Examiner*—Robert M. Fetsuga
*Attorney, Agent, or Firm*—Henderson & Sturm LLP

[57] ABSTRACT

A protective cover for inflatable swimming pools having a plurality of inflated, wall forming rings fabricated from polyvinylchloride or similar materials. The protective covering, preferably a tough, durable synthetic fabric such as nylon, includes a top wall, a side wall, and a bottom wall, with at least two reinforcement straps connecting opposing sides of the bottom wall for added strength.

5 Claims, 1 Drawing Sheet

PROTECTIVE COVER FOR INFLATABLE SWIMMING POOLS

CROSS-REFERENCE TO RELATED APPLICATIONS

Not Applicable.

STATEMENT REGARDING FEDERALLY SPONSORED RESEARCH OR DEVELOPMENT

Not Applicable.

AUTHORIZATION PURSUANT TO 37 C.F.R. §1.71 (d) (e)

A portion of the disclosure of this patent document, including appendices, may contain material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND OF THE INVENTION

1. Field of the Invention

This invention relates to inflatable swimming pools, and more particularly to a protective cover for enclosing an inflatable swimming pool for improved strength, puncture resistance, and durability.

2. Description of the Related Art

Inflatable swimming pools are well known in the art and generally comprise a single inflatable ring with a flooring sealed to the ring around its lower edge and typically fabricated from various plastics or polyvinylchloride (PVC). With the increasing costs of in-ground concrete swimming pools, however, larger above-ground pools with increased depth have become more popular. Inflatable pools, however, have heretofore been unsuitable with the increased depth due to the tremendous increase in water pressure on the sides of the pool which causes the walls to deform and tear. This has led to above-ground pools with wooden or metal superstructures generally supporting a plastic liner.

BRIEF SUMMARY OF THE INVENTION

The present invention discloses a protective cover for inflatable swimming pools having a plurality of inflated, wall forming rings fabricated from polyvinylchloride or similar materials. The protective covering, preferably a tough, durable synthetic fabric such as nylon, includes a top wall, a side wall, and a bottom wall, with at least two reinforcement straps connecting opposing sides of the bottom wall for added strength.

BRIEF DESCRIPTION OF THE SEVERAL VIEWS OF THE DRAWINGS

Other objects, advantages, and novel features of the present invention will become apparent from the following detailed description of the invention when considered in conjunction with the accompanying drawings, wherein.

DETAILED DESCRIPTION OF THE INVENTION

Figure 1:
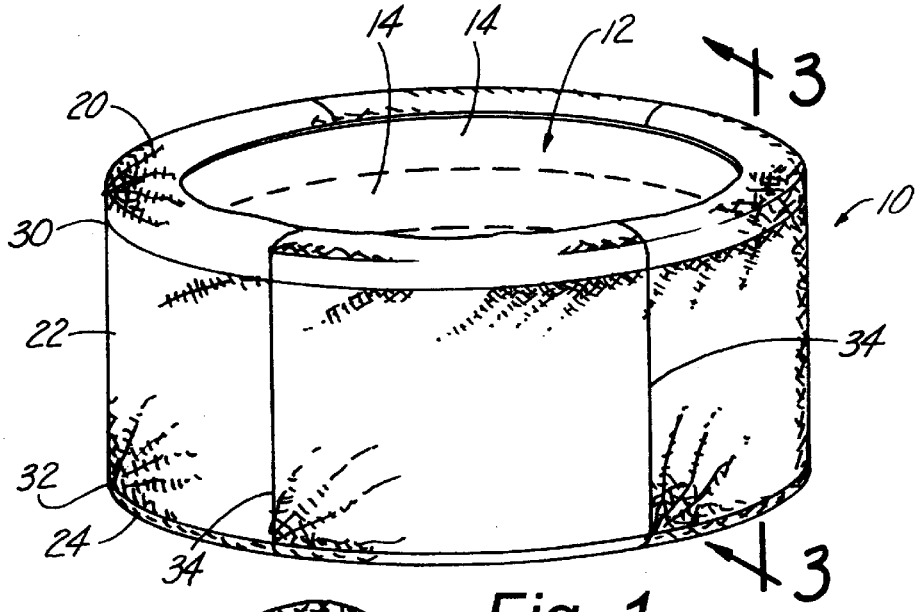
FIG. 1 is a perspective view of the side and top of the invention.

Referring now to the drawings, wherein like reference numerals designate identical or corresponding parts throughout the several views, FIG. 1 shows the protective cover 10 of the invention in combination with an inflatable swimming pool 12. In this instance, the swimming pool 12 is comprised of three polyvinylchloride (PVC) rings 14 which are secured together by thermowelding and a PVC floor 16 which is thermowelded to the lower surface of the bottom ring 14.

The protective cover 10 includes a top wall 20, a side wall 22, and a bottom wall 24, preferably fabricated from a durable synthetic fabric such as nylon, polyester, or. DACRON a registered trademark of Dupont Corporation. An acceptable fabric is a 600 D nylon commercially available under the name cordura. Alternate nylon fabrics may range from approximately 420 D to approximately 1,000 D.

In the illustrated embodiment, the top wall 20 and bottom wall 24 are attached to the side wall 22 along their peripheral edges by seams 30, 32. In addition, the sidewall 22 is comprised of six panels which are sewn together along seams 34. It should be obvious to one skilled in the art that the seams may be arranged in any number of ways for function, aesthetics, or efficient use of the fabric and, that the inflatable swimming pool (12) must be at least partially deflated to be inserted within the confines of the protective cover.

Figure 2:
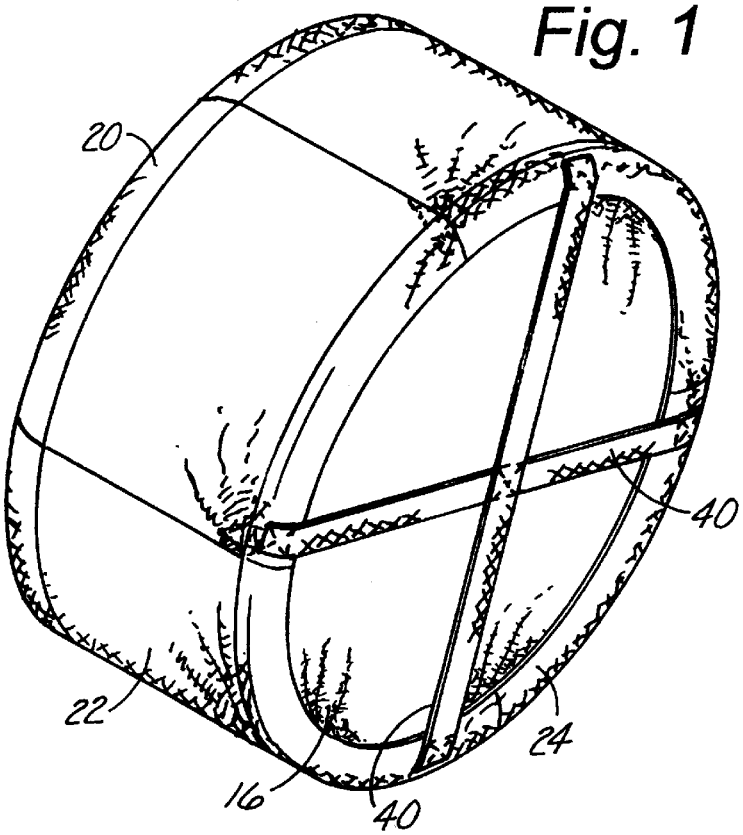
FIG. 2 is a perspective view of the side and bottom of the invention.
Figure 3:
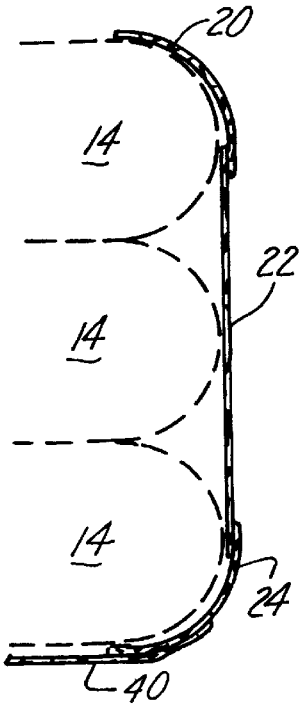
FIG. 3 is a sectional view of the invention taken along line 3—3 of FIG. 1.

As seen in FIG. 2, the bottom wall 24 has a pair of reinforcement straps 40 affixed to opposing sides and extending across the bottom 16 of the pool 12 to provide additional strength to the cover 10. The reinforcement straps 40 are preferably sewn together where they cross in the middle of the pool bottom 16.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

What is claimed is:

1. A protective cover for an inflatable swimming pool including a plurality of stacked inflatable rings including at least an upper inflatable ring and a lower inflatable ring and a floor extending across the bottom of the lower inflatable ring; wherein, the protective cover comprises:

a flexible enclosure including a top wall, a side wall and a bottom wall wherein said top wall and said bottom wall extend interiorly from said side wall and overlap at least a portin of the upper and lower inflatable rings respectively; and a plurality of reinforcement straps affixed to and extending between opposing sides of said bottom wall; wherein said reinforcing straps are disposed beneath the floor of said inflatable swimming pool.

2. The protective cover as in claim 1 wherein at least the side wall is made of a durable fabric material to reinforce said inflatable swimming pool and resist the puncture thereof.

3. The protective cover as in claim 2 wherein, said durable fabric material is made of nylon fabric.

4. In combination:

(a) an inflatable swimming pool comprising a plurality of stacked inflatable rings including at least an upper inflatable ring and a lower inflatable ring and a floor extending across the bottom of the lower inflatable ring; and (b) a protective cover comprising a flexible enclosure including a top wall, a side wall, and a bottom wall wherein said top wall and said bottom wall extend interiorly from said side wall and overlap at least a portion of the upper and lower inflatable rings respectively.

5. The combination as recited in claim 4 wherein said protective cover further includes a plurality of reinforcement straps affixed to, and extending between opposing sides of said bottom wall; wherein, said reinforcing straps are disposed beneath the floor of said inflatable swimming pool.

* * * * *